United States Patent [19]

Huckle

[11] Patent Number: 4,666,538

[45] Date of Patent: May 19, 1987

[54] SHEET FEEDING APPARATUS

[75] Inventor: Ralph E. Huckle, West Sussex, England

[73] Assignee: De La Rue Systems Limited, United Kingdom

[21] Appl. No.: 734,874

[22] Filed: May 16, 1985

[51] Int. Cl.[4] ..... B32B 31/16

[52] U.S. Cl. ..... 156/73.1; 29/527.1; 264/155; 264/259; 264/271.1; 271/107

[58] Field of Search ..... 228/161; 29/463, 557, 29/558, 527.1; 271/90, 93, 99, 100, 106, 107; 264/138, 152, 155, 156, 23, 259; 156/73.1, 73.3

[56] References Cited

U.S. PATENT DOCUMENTS 3,077,983 2/1963 Middleditch ..... 271/100 X 4,358,100 11/1982 Müller ..... 271/100 X

*Primary Examiner*—Richard A. Schacher

*Attorney, Agent, or Firm*—Ostrolenk, Faber, Gerb & Soffen

[57] ABSTRACT

This concerns apparatus for removing sheets one at a time from a stack using a suction feeder assembly comprising an oscillating shaft on which two suction feeder arms have been mounted so as to communicate through holes in the shaft and through the hollow shaft interior with a suction source. Such assemblies have needed very precise alignment and to reduce the cost of making such an assembly, an integral plastics member (FIG. 5) is moulded on to the shaft, this moulding comprising the two suction arms (12, 13) and a member (14) interconnecting the suction arms with a precise spacing. The moulding further includes two channels (21) for the passage of a drill, allowing holes to be made in the shaft through the suction arm after the moulding. Subsequently, cover plates are welded over the drill channels (21) and nozzle assemblies (4) are fitted to other apertures in the suction arms. Flats (15, 16) on the ends of the shaft are accurately located in the mould tool relative to the suction arms and are later used to locate end eccentric bearings for the shaft.

5 Claims, 12 Drawing Figures

SHEET FEEDING APPARATUS

This invention relates to a pneumatic sheet feeder of the kind employing a shaft, mounted for oscillatory motion, carrying two spaced suction feeder arms which during their oscillatory angular motion take a sheet from the end of a stack and feed it into a sheet conveyor. Suction is applied to nozzles at the ends of the suction arms through the shaft, which is hollow for at least a part of its length.

The correct location of the suction arms on the shaft is difficult and expensive. They must be correctly aligned with each other, about the axis of the shaft, and must also be correctly aligned over holes in the shaft providing access to its interior. In addition, the two arms must be hermetically sealed to the shaft.

The object of the present invention is to simplify and to reduce the expense of making the suction feeder assembly.

According to the invention, a method of making a suction feeder assembly, having two spaced suction arms on a shaft which is hollow for at least a part of its length, to be mounted for oscillatory motion in a pneumatic sheet feeding apparatus for removing sheets one at a time from a stack, includes the step of moulding on to the shaft an integral member of a plastics material comprising the two spaced suction arms and a member connecting them, and thereafter drilling holes in the shaft through the suction arms, and fitting nozzles to the suction arms so that they communicate through the drilled holes with the hollow interior of the shaft.

The method preferably comprises moulding each suction arm to leave a channel for the passage of the drill and providing in a plastics sleeve coaxial with the shaft a guide for the drill; once the drilling operation has been carried out, a cover plate is sealed over the end of the above-mentioned channel, for example by ultrasonic welding.

In order that the invention may be better understood, an existing method of making the suction feeder assembly will first be described, after which a method according to the present invention will be described, with reference to the accompanying drawings.

In the drawings

Figure 9:
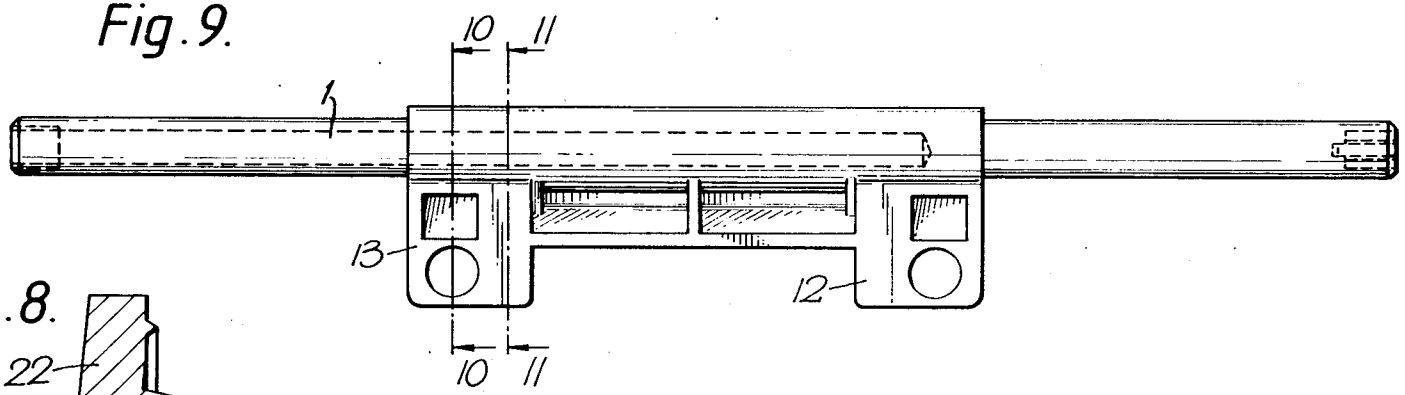
FIG. 9 is a front elevation of the suction feeder assembly.
Figure 10:
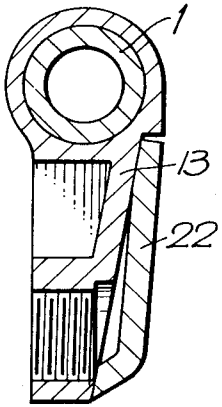
Figure 11:
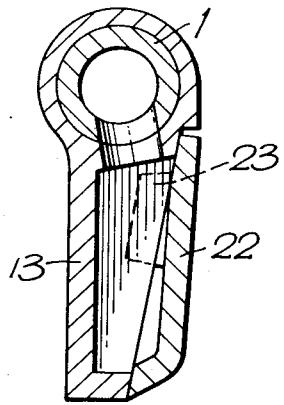
Figure 12:
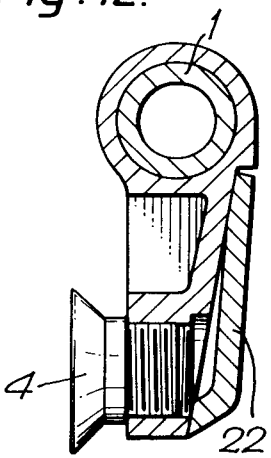

FIGS. 10 and 11 are views on the lines 10—10 and 11—11 respectively of FIG. 9, showing the cover plate in place; and FIG. 12 is a view corresponding to FIG. 10 but showing the suction nozzle in place.

Figure 1:
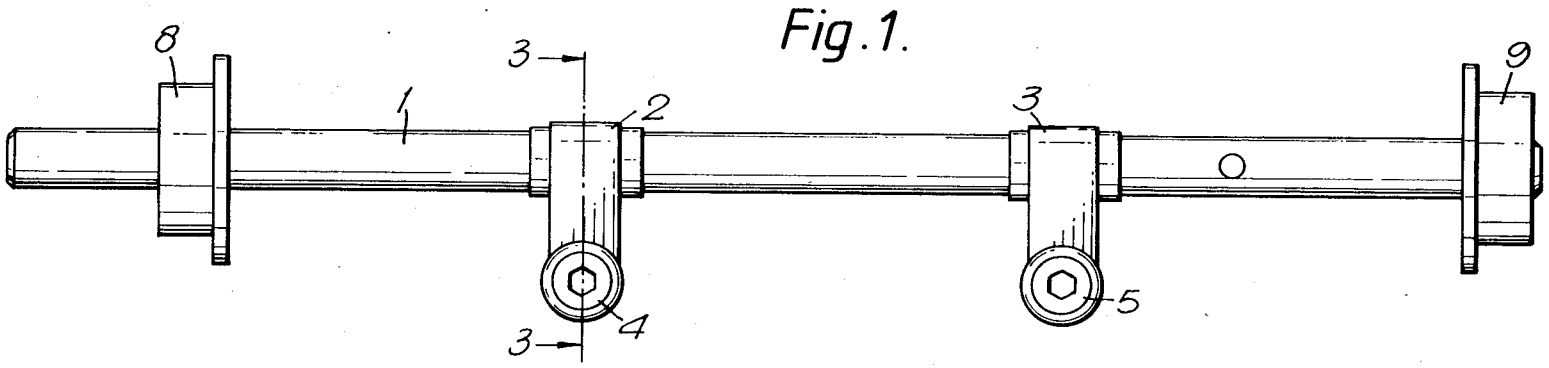
FIG. 1 is a front elevation of a known suction feeder assembly.
Figure 3:
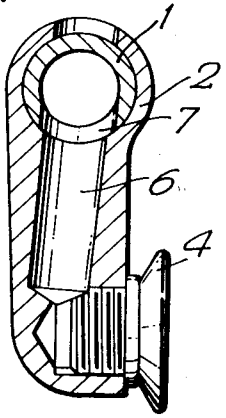
FIG. 3 is a section on the line 3—3 in FIG. 1.
Figure 2:
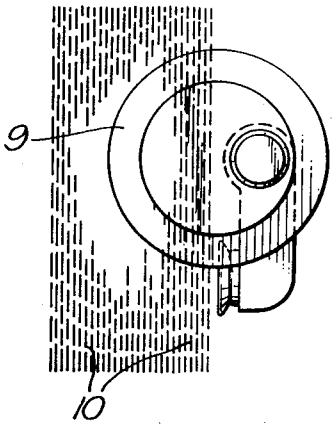
FIG. 2 is an end view of the assembly of FIG. 1, with a stack of sheets indicated in dotted lines.

In FIGS. 1 to 3, which illustrate an existing suction feeder assembly, a shaft 1 which is hollow for at least part of its length carries two suction feeder arms 2 and 3, at the ends of which are respective suction feeder nozzles 4 and 5. As shown in FIG. 3, the nozzle 4 communicates through a passage 6 within the suction feeder arm 2 and through a hole 7 in the shaft 1 with the hollow interior of the shaft. FIG. 2 shows that the suction feeder arm is eccentrically mounted in bearings 8 and 9, so that it recriprocates in an eccentric fashion to pull the notes away from the stack 10 shown in dotted lines in FIG. 2. The provision of two suction arms ensures a more positive pick-up and avoids creasing of the notes.

The shaft 1 passes right through the bearing 8 and is then connected by a rubber hose to a vacuum pump.

It will be seen that in this method, four components need to be accurately aligned with respect to the shaft. The arms 2 and 3 must be carefully aligned with each other, to ensure that they meet the end note of the stack together, and these arms must also be carefully aligned over the pre-drilled holes 7 in the shaft 1. It will be seen that the eccentric bearings must also be correctly positioned relative to the pick-up arms. In the known method of assembly, adhesive is used to fasten and locate each component in the correct position. This requires very careful control and a high-operator skill, since in the absence of these there is a high reject rate due to misalignment and/or vacuum leaks.

Figure 4:
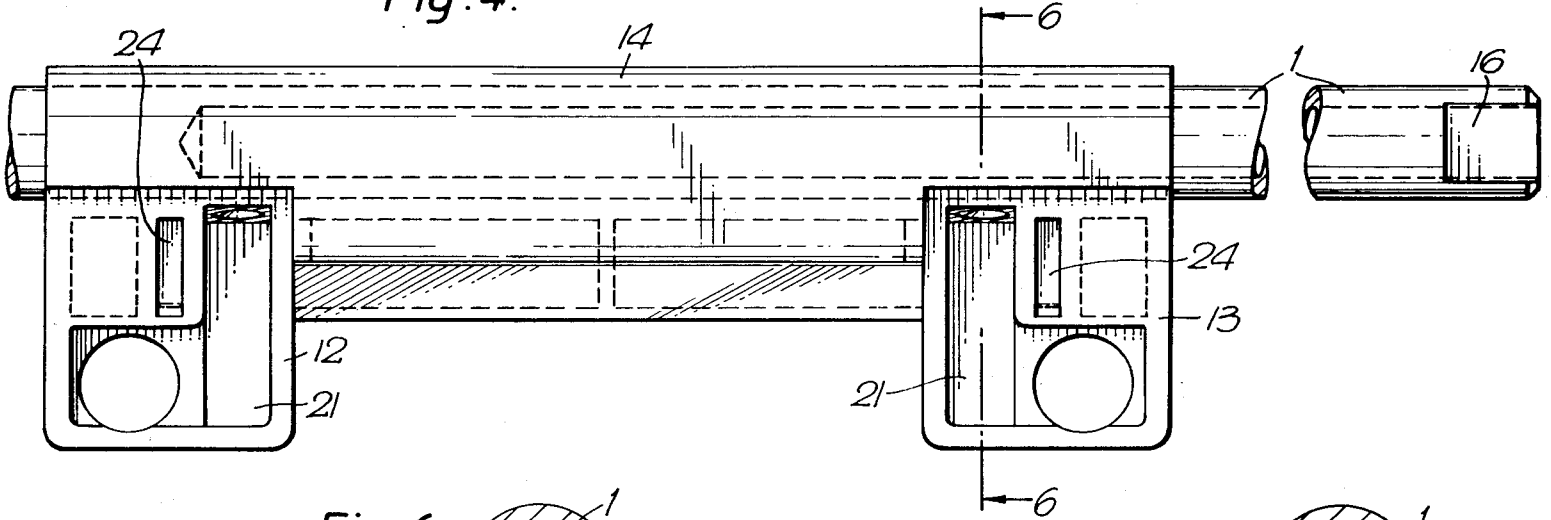
FIG. 4 is a rear elevation of suction feeder apparatus embodying the present invention after the moulding operation.
Figure 7:
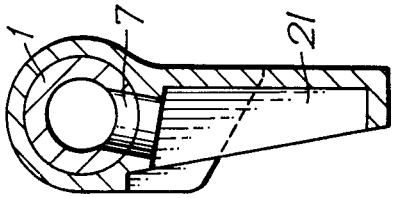
FIG. 7 is a view corresponding to that of FIG. 6 but after the drilling operation.
Figure 6:
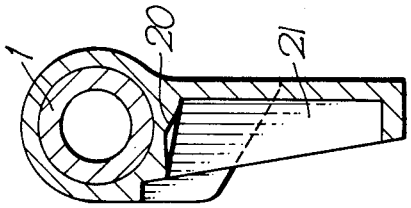
FIG. 6 is a view on the line 4—4 of FIG. 4, before the drilling operation.
Figure 5:
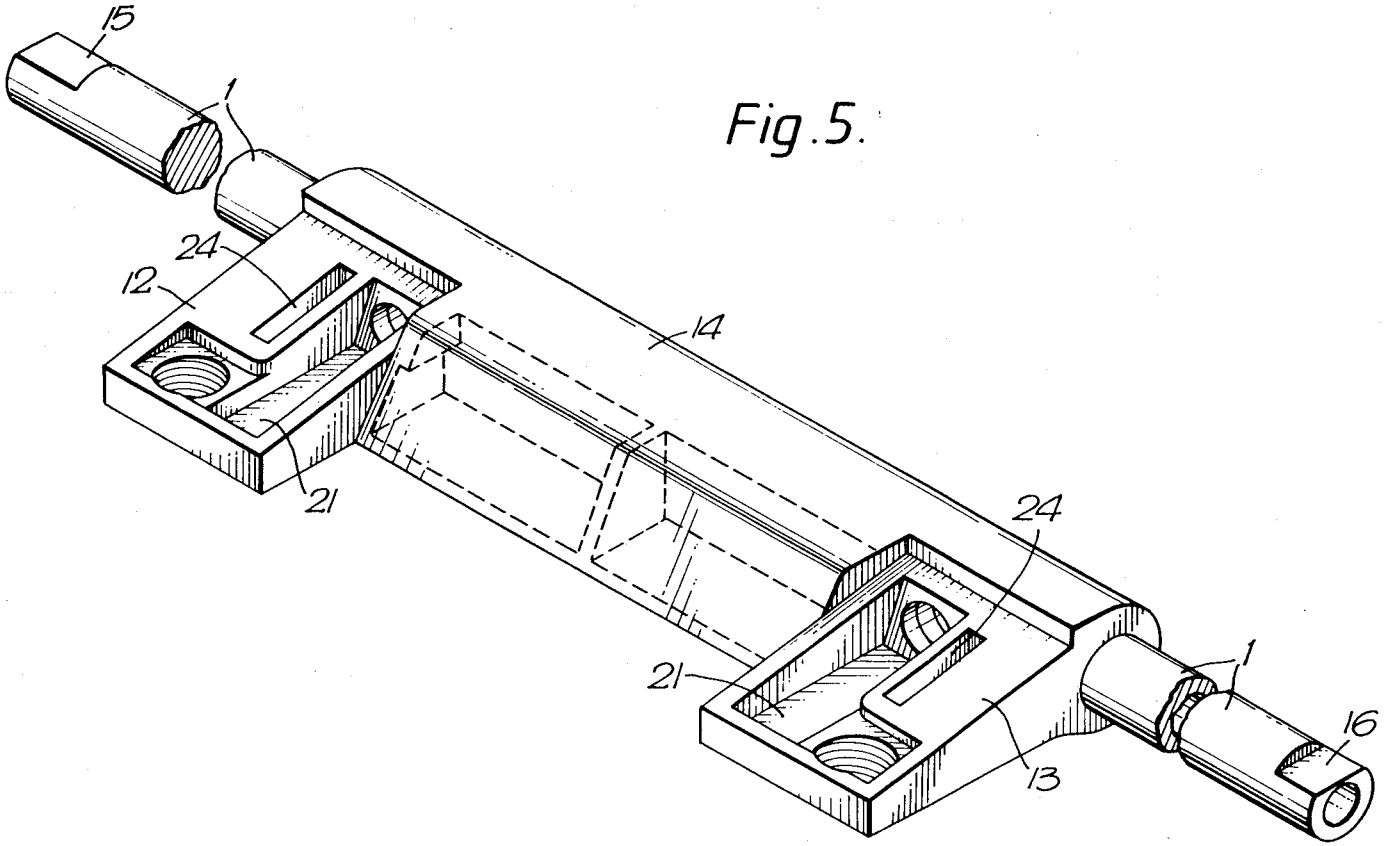
FIG. 5 is a perspective view of the apparatus of FIG. 5, after the drilling of holes into the shaft.

A method embodying the present invention will now be described with reference to the remaining figures of the drawings. FIGS. 4 and 5 illustrate the suction feeder assembly after the moulding operation. The two suction feeder arms 12 and 13 are now formed integrally with a connecting member 14 on the steel shaft 1 in the moulding operation. Flats 15 and 16 on the end of the shaft are accurately located in the mould tool relative to the pick-up arms 12 and 13 and are later used to locate the end eccentric bearings. The shaft is not pre-drilled through its cylindrical periphery but instead a break-through drilling operation is done after moulding. To facilitate this drilling operation, "dimpled" locations 20 (FIG. 6) are provided in small chambers 21 formed in the moulding operation. FIG. 7 is a view corresponding to that of FIG. 6 but after the drilling operation has taken place.

Figure 8:
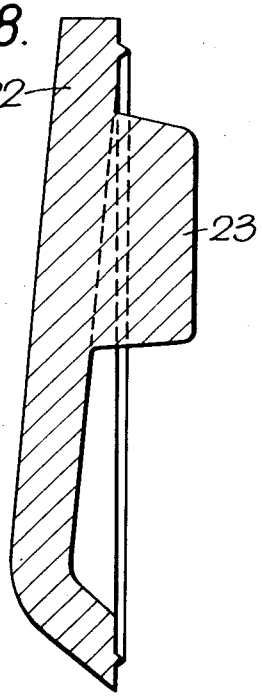
FIG. 8 is a sectional view of a cover plate.

The nozzle holes are then tapped and after this a cover plate 22, shown in FIG. 8, is ultrasonically welded over the nozzle and break-through chambers. The cover plate has a locating lug 23, fitting into a recess 24 moulded into of the suction arms, to simplify assembly of the cover plate on the suction arm. The suction feeder assembly has now reached the stage shown in FIGS. 9 to 11, FIG. 9 being a front view of the assembly and FIGS. 10 and 11 sectional views taken on the line 10—10 and 11—11 respectively. It will be evident from the drawings and description that correct location of the two suction arms relative to one another has been provided automatically, since they are formed as one component. Sealing has been accomplished partially by the moulding operation and finally by an easily controlled ultrasonic welding operation. In addition, no angular alignment of the suction arms with respect to pre-drilled holes in the shaft has been required.

The provision of flats 16 on the ends of the shaft 1 has also ensured the correct fitting of the shaft into end eccentric bearings, which can be made from pressure die-cast zinc/aluminium base alloy, which will give extremely good dimensional accuracy, good bearing qualities and a good surface finish. D-shaped holes can be accurately positioned in the castings and when fitted to the shaft they provide an accurate and close-fitting assembly. Finally, replaceable flexible nozzle assemblies 4 are inserted into the tapped holes in the suction arms, as shown in FIG. 12.

The method of forming the suction feeder arms on the shaft and sealing them to the shaft described above would be equally applicable if the eccentric movement of the suction feeder assembly were not provided. With no eccentric movement, the vacuum shaft would pass straight through simple bearings in side plates, without the need for both eccentric end bearings and further bearings fitted to the side plates.

The method which has been described enables the suction feeder assemblies to be made more simply and much less expensively than hitherto and also more accurately than in the prior method. Furthermore, it does not require highly skilled assembly techniques. As a consequence, the rate of rejection of the assemblies is greatly reduced.

In a modification of the above-described method, the flats 15 and 16 are machined on the shaft ends after the moulding operation.

I claim:

1. A method of making a suction feeder assembly, said assembly having a shaft which is hollow for at least a part of its length and two spaced suction arms on said shaft, adapted to be mounted for oscillatory motion in a pneumatic sheet feeding apparatus for removing sheets one at a time from a stack, the method including the step of moulding on to said shaft an integral member of a plastics material comprising said two spaced suction arms and a member connecting them, and thereafter drilling holes in said shaft through said suction arms, and fitting nozzles to said suction arms so that they communicate through said drilled holes with said hollow interior of said shaft.

2. A method in accordance with claim 1, further comprising forming in each said suction arm, in addition to a hole for said nozzle, a channel for the passage of a drill and, after the drilling operation, sealing a cover over said drill channel.

3. A method in accordance with claim 2, in which said cover is sealed in position by ultrasonic welding.

4. A method in accordance with claim 1, in which said shaft defines D-shaped ends which are used to locate said shaft in a mould for carrying out said moulding step and thereby to ensure a fixed angular relationship, relative to an axis defined by said shaft, between said integral plastics assembly and said D-shaped ends, said D-shaped ends are being subsequently used to locate said shaft in a predetermined angular position relative to end bearings.

5. A method in accordance with claim 1, wherein said shaft defines a pair of ends, the method further comprising mounting said ends of said shaft eccentrically in end bearings, whereby said suction arms undergo an eccentric oscillatory motion.

* * * * *